US006926280B2

(12) United States Patent
Abuan

(10) Patent No.: US 6,926,280 B2
(45) Date of Patent: Aug. 9, 2005

(54) LUCKY NINE CARD GAME

(76) Inventor: Ramoncito D. Abuan, 6357 Apple Orchard Dr., Las Vegas, NV (US) 89122

( * ) Notice: Subject to any disclaimer, the term of this patent is extended or adjusted under 35 U.S.C. 154(b) by 0 days.

(21) Appl. No.: 10/669,036

(22) Filed: Sep. 23, 2003

(65) Prior Publication Data

US 2004/0178581 A1 Sep. 16, 2004

Related U.S. Application Data

(63) Continuation-in-part of application No. 10/260,907, filed on Sep. 30, 2002, now abandoned.

(51) Int. Cl.[7] ..... A63F 1/03
(52) U.S. Cl. ..... 273/292; 273/274; 273/309
(58) Field of Search ..... 273/292, 274, 273/309

(56) References Cited

U.S. PATENT DOCUMENTS 5,366,228 A * 11/1994 Kangsanaraks ..... 273/292
5,397,128 A * 3/1995 Hesse et al. ..... 273/292
5,496,038 A * 3/1996 Kangsanaraks ..... 273/292
5,529,309 A * 6/1996 Bartlett ..... 273/292
5,605,333 A * 2/1997 Field ..... 273/274
5,632,487 A * 5/1997 Nguyen ..... 273/292
5,769,422 A * 6/1998 Stromer ..... 273/274
6,511,072 B1 * 1/2003 Santa Cruz et al. ..... 273/292
6,575,466 B1 * 6/2003 Lizak ..... 273/292
6,592,125 B1 * 7/2003 Lizak ..... 273/292

* cited by examiner

*Primary Examiner*—Gregory Vidovich
*Assistant Examiner*—D Collins
(74) *Attorney, Agent, or Firm*—Maria Erlinda Co Sarnc

(57) ABSTRACT

This is a card game with an object of reaching a count of nine. In this card game, the player completes playing his/her hand before knowing the count value of the dealer's hand. The player makes all the decision on the play of his/her hand while the dealer has limited or no option in the play of his hand. The game allows for additional rules or features that can increase the excitement in playing the game or swing the odds of winning either for the player or the dealer such as splitting or giving special payouts on certain hands.

19 Claims, 1 Drawing Sheet

LUCKY NINE CARD GAME

This is a continuation-in-part application of Ser. No. 10/260,907 filed on Sep. 30, 2002, now abandoned.

BACKGROUND

This invention relates to a card game with an object of reaching a count of nine. In this game, the player makes all the decision on the play of his/her hand while the dealer has limited or no option in the play of his hand. Hand herein means the playing cards and their respective score or count value in one's possession.

Various card games, some adopted as wagering card games, have been developed in the past wherein the object is to reach a winning count such as 21 for the game of blackjack, with all the cards scoring above 21 losing the game. A wagering card game means that the players play for money. In a wagering card game, there is usually a dealer who plays for the house, i.e., usually a casino, and players, usually of a desired number, whose object is to beat the dealer's hand and win for money.

U.S. Pat. No. 5,366,228 discloses a card game wherein the number cards from ace to nine are valued at face value with the tens and court cards (jack queen and king) having a value of zero. The one who scores nearest to nine or nine wins. In this card game, a dealer having a flush, his two or three cards having the same suit, for example, all hearts or all spades, or having a three of a kind wins a player whose cards are less than nine. The player with the same situation, flush or three of a kind, on the other hand, still loses if the player's hand is lower than that of the dealer's or when the dealer's hand is nine. The player wins the game if his count or hand is closer to nine or nine and the dealer scores less than the player. The player takes additional payoff if the cards/hand are a flush and totals nine. A player with a flush hand but scoring less than nine only gets an even pay off, that is getting the same amount as his/her bet. A player having the same count as the dealer neither wins or loses. This card game limits a player's chances of winning.

U.S. Pat. No. 5,529,309 discloses a card game similar to U.S. Pat. No. 5,366,228 with a hand close to nine or nine winning the game but differs in that it does not have the rules relating to a flush or a three of a kind. It, however, has rules for tied hands and non-zero. In this card game, a dealer's hand is played first to its final count before the players play their hands or cards. Consequently, a player already knows the dealer's hand even before playing his/her hand which somewhat removes the excitement from the game as well as limits the player's decision making.

It is therefore an object of this invention to provide a player with a card game where his decision making and risk taking is maximized by letting him play his hand without knowing the dealer's hand.

It is also an object of this invention to provide a card game where the players has more options than the dealer without taking away a level of advantage for the dealer to make the game adoptable to a casino setting.

It is also an object of this invention to provide a card game where the odds of winning can be increased or decreased by selecting features or rules of the card game that would correspondingly increase or decrease the odds of winning for either the player or the dealer.

It is also a further object of this invention to provide a player having two cards of equal numerical point value, a chance to play more than one hand in a game or to give additional chances of winning by splitting the hand and betting on the resulting split hands.

It is also a further object of this invention to provide additional rules or options to a main method of playing the card game, the choosing of one or more of these rules or options giving the player or the dealer the ability to change the odds of winning.

SUMMARY OF THE INVENTION

Figure 1:
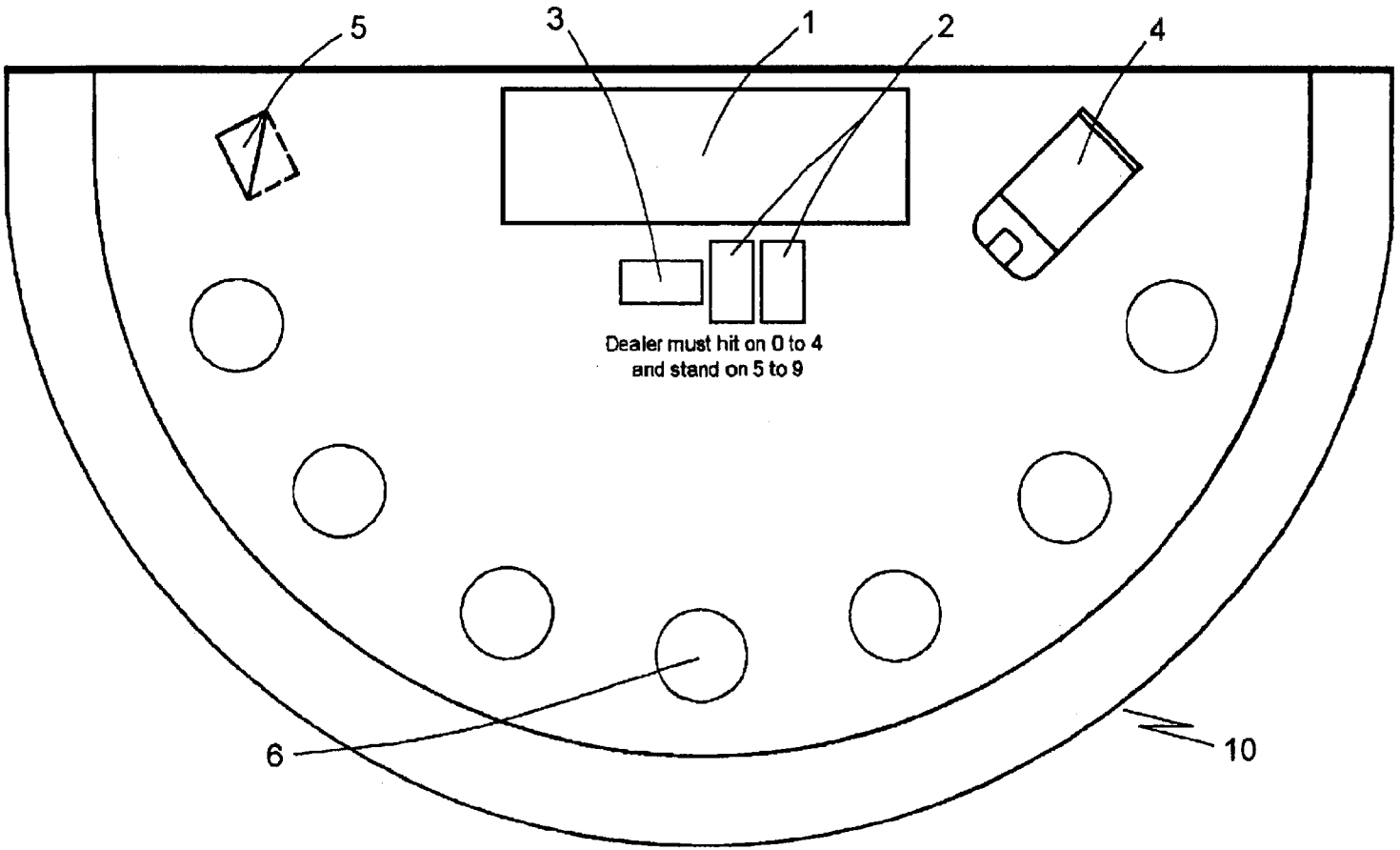
FIG. 1 is a plan view of a table layout that can be used in playing the card game in a casino setting.

This invention relates to a card game with an object of reaching a count of nine. In this game, the player completes his hand before the dealer reveals the point value of his hand. Also, the player makes all the decision on the play of his/her hand while the dealer has limited or no option in his play. The card game can be played at a minimum by at least one player and a dealer.

The method of playing the card game comprises:

(a) providing at least one deck of playing cards comprising four suits totaling fifty two cards, with each suit including thirteen cards ranking from ace to ten and through court cards, jack, queen and king, the deck of cards shuffled before playing;

(b) assigning a point value to each of the playing cards, with the ace through nine of each suit counted at face value of one through nine points, and the ten through king of each suit being assigned a point value of zero by dropping the tens digit;

(c) dealing an initial player's hand of two cards, preferably all face up, to the player and an initial dealer's hand of two cards to the dealer, the point value of the initial dealer's hand not revealed by dealing at least one of the two dealer's cards face down;

(d) adding the point values of the initial player's hand, dropping the tens digit of the point value if any, to provide a count value between zero and nine;

(e) hitting a third card by the player if desired and adding the point values of the resulting three card player's hand, dropping the tens digit of the sum of the three card player's hand if any, to provide a count value between zero and nine;

(f) exposing the initial dealer's hand after the player has acted completely on his hand thereby revealing the point value of the initial dealer's hand;

(g) adding the point values of the initial dealer's hand and dropping the tens digit of the point value to provide a count value between zero and nine;

(h) completing the dealer's hand by hitting a third playing card when the point value of the initial dealer's hand is zero to four and standing if the point value is five to nine;

(i) adding the point value of the dealer's hand, dropping the tens digit if any, to provide a final count value between zero and nine; and, (j) comparing the final count value of the dealer's hand with the count value of the player's completed hand, a player's completed hand having a count value closer to nine and greater than the dealer's final count value resulting in a win for the player, a player's completed hand having a count value equal to the dealer's final count value resulting into a tie, and a player's completed hand having a count value less than the dealer's final count value resulting in a loss for the player.

The player's completed hand is preferably but not necessarily limited to a maximum of three. The dealer can not have more than three cards. Additional rules may be adopted or added to the main rules or main method of playing the card game disclosed above. The adaptation of all or some of the additional rules changes the odds of winning as well as add variety and excitement to the game. One additional rule allows a player having a hand of three cards with each card having a point value of three or a hand of three cards of the same suit with one card having a point value of two, a second card having a point value of three and a third card having a point value of four to automatically win the game. On another rule, the player may be allowed to split an initial pair of cards having equal numerical values into separate hands and play each hand independently. The number of separate hands a player can play after splitting may be limited. The player and dealer may also agree that a player or dealer scoring nine on a two card hand wins over a player scoring nine on a three card hand. However, if the hand of three cards with each card having a point value of three (3—3—3) or a hand of three cards of the same suit with one card having a point value of two, a second card having a point value of three and a third card having a point value of four (3-2-4) is ruled to automatically win, then this hand would win over the two card hand of nine. Allowing the player to split his/her cards or to win on a 3—3—3 or a 2-3-4 is optional. Further, a two card nine with a face card or ten card may be distinguished from a two card nine without a face card or a ten card, the latter either given a better payout or a lesser payout in a wagering game. To increase the odds of winning for the dealer, the dealer may be ruled to win an all zero tie or given an automatic win when the player's completed hand is two or less even before the dealer starts playing his/her hand. In a wagering game, the dealer immediately collects the losing player's bet before playing his hand. On a wagering card game, a bet on the outcome of the play is placed by the player before the initial player and dealer's card are dealt. The determination when a player wins or loses are dictated by the rules of the game while the amount of payouts given are dictated by the house based on the level of advantage desired. In a casino setting, a cut card is usually used to signal when to terminate the dealing of the cards during the play. To prevent switching of the cards, the third card is preferably but not necessarily dealt at a position different from the initial or original two cards dealt to the player and to the dealer.

DETAILED DESCRIPTION OF THE INVENTION

The card game is played using one or more standard deck of playing cards, also referred to herein simply as cards, with each deck comprising fifty two cards of four suits. Each suit contains thirteen cards, from ace (one card) through king. The ace through nine of each suit are counted at face value of one through nine for purposes of determining the score, count or point value (all used interchangeably herein to mean the same) of each hand, while the ten, jack, queen and king of each suit is given a point value of zero. The final count, score or point value is the last digit of the sum total of all the cards in one's hand. For example, a three card hand of a ten or jack, a two and a five would equal 17. The tens is drop and the final count value would be 7 in this case.

If the card game is played in a social setting, one standard deck of playing card would be sufficient. However, when played as a wagering game, especially if played in a casino setting, usually five decks of cards or more are used. A dealer playing for the house, usually a casino, shuffles the deck of cards manually or uses a shuffling machine to do so. Use of more decks in a wagering game prevents one to memorize the cards already dealt with. This also reduces the number of shuffling times. Shuffling takes away playing time which in a casino setting is costly because the more number of deals mean more money for the house.

The game can be played at a minimum by a dealer and one player but more players are desired. The object of the game as the title denotes is to score a nine or close to nine and to score better than the dealer. In this card game, after the dealer has shuffled the cards and if it is a wagering game, after the players have placed their bets on the outcome of the card game, the dealer begins the game by dealing each player and himself a card faced up. The cards can be dealt manually but in a casino setting, the cards are usually dealt from a shoe, a device used to hold the cards before they are dealt. After the first card, the players are dealt with a second card, preferably face up, thus showing their individual scores. The dealer also deals himself a second card but this card is face down, thus not revealing the point value of the dealer. The dealer may deal the cards in any direction, counterclockwise or clockwise starting from the player to the left or right of the dealer. This is at the discretion of the dealer or the house. From the score or point value of the two cards, the player can either stand, meaning, not ask for another card or hit, meaning ask for a third card. The player makes this decision without knowing the dealer's score or point value. A player can be limited to a maximum of three cards in a hand. When a player asks for a third card, the dealer preferably but not necessarily, deals this card face up and places this card at a position different from the initial or original two cards, for example, perpendicular to the initial two cards to distinguish the third card. This type of dealing prevents a player from swiftly switching the third card with one of the initial two cards and claiming that he/she did not ask for a third card. A player in this card game, is not limited by any rules on his/her choice of drawing a third card except his/her own risk taking disposition.

After all the players have acted completely on their hands, either by hitting or standing, the dealer exposes his faced down card to reveal the point value of his initial hand. The ability of the dealer to stand or hit a third card is governed by the following rules:

a) If the value of the initial dealer's hand is 0 to 4, the dealer must hit a third card.

b) If the value of the initial dealer's hand is 5 to 9, the dealer must stand.

If the dealer is allowed to hit a third card based on the above rules, the dealer preferably but not necessarily places the third card face up and at a position different from the initial dealer's card, for example, perpendicular to the other two initial cards, to distinguish this third card. Subsequent to the completion of the dealer's play, the final count value of the dealer's hand is compared with each completed player's hand. A player's completed hand having a count value or score of 9 or close to nine wins the game if the dealer scores less than the player's hand. The same is true for the dealer. The dealer wins if the dealer's hand is nine or closer to nine than the player. If both the dealer and the player have the same score, a tie, neither one wins or lose. For example, a card of two and three (equalling 5) for the dealer can tie with a player having the same combination of cards or different combinations of cards but still totalling a five such as two cards of one and four or three cards of ten, two and three. The winner collects the bet of the loser in a wagering game.

The above discloses the main rules of the game. However, several variations or rules may be adopted either to make the game more exciting or increase the odds of winning for either the player or the dealer. In a wagering game, increasing the odds for the dealer is important especially in a casino setting. However, it is conceivable that sometimes, a casino can opt to purposely lower its odds of winning to attract more player or may adopt some rules occasionally, for example on a "special odds day" announced to the public. The variation may come by way of adding rules to the main rules of the card game or by simply declaring which combinations or hand is better than the other or which hand automatically wins or loses.

A nice addition that could add excitement to the game is giving the player an ability to split his/her card. Here, a player having an initial pair of cards having equal numerical value such as two cards of two or two cards of 5, a card of ten and a card of jack (each having a point value of zero), a card of jack and a card of queen (each having a point value of zero), a pair of court cards, etc. can opt to split these cards into two separate hands and play each hand independently in the same manner as above, with each hand limited to a maximum of cards, for example, three cards. However, if during the play of one or both of the split hands, the player gets a second card of the same score or point value as the split hand, then the player can resplit the hand and play a third separate hand. For example, a player getting a pair of cards of five, can split this into two separate hands, each having a five card. After the split, a player plays each hand independently. The first split hand as well as the second split hand will each be dealt with a second card. If the second card for the first hand is a 6 card, the total sum of the two cards is 11 but since the tens digit is dropped, the score or point value of the first split hand is 1. At this point, the player can hit a third card or stand on the point value of the two cards for the first split hand if the final score is not one that will make him lose automatically. If the first split hand opted a third card and the value is a ten from a court card or ten card, the final count value remains as one since the tens digit is dropped. However, if the third card is say a 6 card, then the final value of the first split hand is 7. If the second card dealt for the second split hand is another five, the same as the point value of the card on which the original split was made, the player can opt to resplit this further resulting in a third separate hand and play on the second split hand and the third split hand in the same manner as above. The maximum number of splitting allowed is at the discretion of the house or according to a number agreed among the players and dealer before the game. The illustration above limits the splitting to two resulting in three separate split hands. The above rule can be further limited to require that a face card should be the same court card before it can be split, that is only a pair of jacks or a pair of queens or a pair of kings can be split instead of allowing to split a two face card of queen and jack, king and queen, etc. In a wagering card game, the bet placed for each split hand is preferably but not necessarily the same amount as the original bet, the bet placed initially by the player on the unsplit hand, the hand before splitting. This option to split may or may not be made part of the card game depending upon its effect on the odds of winning for either the player or the dealer. Its inclusion, however, will provide added excitement and incentive for players to play this card game.

A rule can put distinction between a two card of nine and a three card of nine and even go further in differentiating the set of two cards of nine, for example, a two card of nine consisting of non-faced cards or a ten cards such as two cards of 1,8; 2,7; 3,6; and 4,5 may be considered a better or a worse hand than a two card of nine having a face card or a ten card. This distinction in the two cards of nine can be differentiated by identifying or naming, for example, the non-faced cards of nine as "lucky nine" and the faced card of nine with ten included, as "natural nine" or vice versa depending on which combination will be considered a better hand than the other. The player and the dealer, may a rule that a two card hand of nine wins over a three card of nine. An exception to this rule may be adopted when the three card hand is a combination of 3—3—3, three cards with each card having a point value of three of any suit or a hand of 2-3-4, three cards of the same suit with one card having a point value of two, a second card having a point value of three and a third card having a point value of four. These three card combinations may be ruled to be an automatic pay for the player. A dealer can never have these hands to tie the game with the player because the dealer stands at any score of five or over.

The odds can also be varied by simply limiting or establishing the conditions for winning or losing the game aside from just looking at the proximity of the scores to nine. For example, to increase the odds for the dealer, an important consideration for a casino, the game may simply rule on who will get the wagers or bets in cases of an all zero tie or even expand this further in cases when the ties are at the very low scores of one or two, for example. A rule giving an automatic win for the dealer in cases such as an all zero tie, all one tie or all two tie will swing the odds in favor of the dealer. This odds can be further bolstered by declaring an automatic loss for the player scoring two or less, including zero, on a completed hand even before the dealer starts to play his hand. An example of an all zero tie is when the dealer's hand is a ten, two and eight, thereby having a final score of zero after dropping the tens digit and the player has the same combination of cards, a ten, two and eight, or other combinations totalling zero, for example, a ten, three and seven.

The specific amount or rate of payout in a wagering game scenario also affects the amount that can be won by either the player or the dealer. As in the above, this is also up to the house or casino which is naturally dictated by the odds and degree of advantage desired. Usually, but not necessarily, the winning hand is paid even money, that is, if the bet is $5.00, then the dealer pays the player $5.00, resulting in $10.00 for the player to either keep or bet the whole or a portion thereof for the next game. The house or casino may decide to pay more, herein referred to as special payout, for a selected winning player hand, for example, a 6 to 5 payout (a $5.00 bet winning $6.00) or more on a "lucky nine", a combination of two cards (either with or without a face card as the case may be) having a total count value of nine or for the hand having the combination of 3—3—3 of any suit and 2-3-4 of the same suit or for both instances as stated above. For example, the house can decide to give a "lucky nine" card a 6 to 5 or more payout while giving a "natural nine" an even payout, that is, the same amount as the bet placed by the player.

Obviously, all these rules or some of these rules and conditions can be arbitrarily implemented in a non-wagering scenario. In a wagering game usually played in a casino setting, the effect of each of these added rules and variations are carefully considered and the rules or combination of rules are picked and set by the degree of odds or advantage desired by the house.

In a wagering game at a casino setting, an example of a method for playing the card game giving favorable odds for the house is as follows: (a) providing more than one deck of playing cards comprising four suits totaling fifty two cards, with each suit including thirteen cards ranking from ace to ten and through court cards, jack, queen and king, the deck of cards shuffled before playing; (b) assigning a point value to each of the playing cards, with the ace through nine of each suit counted at face value of one through nine points, and the ten through king of each suit being assigned a point value of zero by dropping the tens digit; (c) dealing an initial player's hand of two cards to the player and an initial dealer's hand of two cards to the dealer, the point value of the initial dealer's hand not revealed by facing at least one of the two dealer's cards down; (d) adding the point values of the initial player's hand or the player's separate hands and dropping the tens digit of the point value if any to provide a count value between zero and nine; (e) hitting a third card by the player if desired and adding the point values of the resulting three card player's hand, dropping the tens digit of the sum of the three card player's hand to provide a count value between zero and nine; (f) declaring an automatic loss for the player having a completed hand scoring two or less, including zero; (g) exposing the initial dealer's hand after the player has acted completely on his hand thereby revealing the point value of the initial dealer's hand; (h) adding the point values of the initial dealer's hand and dropping the tens digit of the point value to provide a count value between zero and nine; (i) completing the dealer's hand by hitting a third playing card when the point value of the initial dealer's hand is zero to four and standing if the point value is five to nine; (j) adding the point value of the dealer's hand, dropping the tens digit if any, to provide a final count value between zero and nine; (k) comparing the final count value of the dealer's hand with the count value of the player's completed hand, a player's completed hand having a count value closer to nine and greater than the dealer's final count value resulting in a win for the player, a player's completed hand having a count value equal to the dealer's final count value resulting into a tie, and a player's completed hand having a count value less than the dealer's final count value resulting in a loss for the player; and, (1) ruling a win on a completed hand of two cards scoring a nine over a three card hand scoring a nine.

A recommended table layout 10 for a casino setting is shown in FIG. 1. The layout as drawn is for seven players but the same table layout can be adopted for less or more than seven players. The table may be covered with felt or other suitable material, one that would not interfere in the dealing of the cards. The dealer stands behind the horizontal side of the table. On area 1 is positioned a chip rack to accommodate the wagering tokens paid and received during the play of the game. In front of the chip rack 1 is an indicated area/s 2 where the two initial or original cards of the dealer are dealt and an area 3 where the third card of the dealer is positioned in case the dealer hits a third card. As shown in FIG. 1, area 3 is positioned perpendicular to area 2 to distinguish the third card from the initial or original two cards. On one side of the table, proximate to the dealer, is a shoe 4 which houses the cards to be dealt. On another side of the table, also proximate to the dealer but opposite the shoe 4, is a card discard holder 5. The players stand or sit in front of the bet areas 6, herein shown as circles drawn proximate to the semicircular edge of the table layout. The players face the dealer. The bet areas where a player places his/her bet, can be of any geometric shape aside from the circular betting areas 6 shown or it can be indicated by any design or logo.

To prevent fraud or cheating in a wagering game as well as maximize house advantage, the following example shows how a card game can be played in a casino setting:

At least three decks of cards, preferably 5–8 decks of cards are shuffled manually by the dealer or through a shuffling machine. The house sets the limit for the bets and the players places their bets on their respective betting areas 6. After shuffling, a cut card is usually offered to a player. A cut card is used to signal when to terminate the dealing of the cards during the play. The player is instructed to have the deck of cards cut at least one deck from either end of the cards. One card is usually discarded before initially dealing the cards and no more bets or changes in the bet are usually allowed once the first card is dealt or drawn. Also, the house can set additional rules disallowing a player to change seats, hold their cards or touch their bets. The cards drawn from the shoe 4 should be faced down, otherwise, the subject card is not valid and the game is cancelled. To facilitate communication between the dealer and player, certain hand signals of the player can be set. For example, a right to left wave of the hand (part of the body and not referring to the cards) behind the bet signals the dealer that the player wishes to stand. To hit, one brushes the hand towards oneself behind the wager or bet. As shown above, to prevent card switching, the original two cards, the initial cards dealt to each player, are usually placed at a designated area and at a given card position while the third card, if asked, is dealt at its own specific area and placed in a position different from the initial or original two cards for distinction. When the cut card shows up during the course of the deal, this signals that the ongoing deal should be completed and will be the last deal. If the cut card shows up before the first card is drawn, the previous game will be the last and a reshuffling is called for. This in house rules on the cut card all the more calls for playing with more deck of cards to minimize the number of reshufflings.

While the embodiment of the present invention has been described, it should be understood that various changes, modifications and adaptations may be made therein without departing from the spirit of the invention and the scope of the appended claims. Those skilled in the art will recognize that other and further variations of the game presented herein are possible. The scope of the present invention should be determined by the teachings disclosed herein, the appended claims and their legal equivalents.

I claim:

1. A method for playing a card game by at least one player and a dealer with playing cards, comprising:

(a) providing at least one deck of playing cards comprising four suits totaling fifty two cards, with each suit including thirteen cards ranking from ace to ten and through court cards, jack, queen and king, the deck of cards shuffled before playing;

(b) assigning a point value to each of the playing cards, with the ace through nine of each suit counted at face value of one through nine points, and the ten through king of each suit being assigned a point value of zero by dropping the tens digit;

(c) placing wagers on the outcome of the play by the player in a wagering game;

(d) dealing an initial player's hand of two cards all face up to the player and an initial dealer's hand of two cards to the dealer, the point value of the initial dealer's hand not revealed by dealing at least one of the two dealer's cards face down;

(e) adding the point values of the initial player's hand, dropping the tens digit of the point value if any, to provide a count value between zero and nine;

(f) hitting a third card by the player if desired and adding the point values of the resulting three card player's hand, dropping the tens digit of the sum of the three card player's hand if any, to provide a count value between zero and nine;

(g) exposing the initial dealer's hand after the player has acted completely on his hand thereby revealing the point value of the initial dealer's hand;

(h) adding the point values of the initial dealer's hand and dropping the tens digit of the point value to provide a count value between zero and nine;

(i) completing the dealer's hand by hitting a third playing card when the point value of the initial dealer's hand is zero to four and standing if the point value is five to nine;

(j) adding the point value of the dealer's hand, dropping the tens digit if any, to provide a final count value between zero and nine;

(k) providing a win for the dealer on a score selected from the group consisting of an all zero tie, an all one tie, an all two tie, any two of the scores and all three scores; and, (l) comparing the final count value of the dealer's hand with the count value of the player's completed hand, a player's completed hand having a count value closer to nine and greater than the dealer's final count value resulting in a win for the player, a player's completed hand having a count value equal to the dealer's final count value resulting into a tie, and a player's completed hand having a count value less than the dealer's final count value resulting in a loss for the player.

2. The method for playing a card game of claim 1 wherein the player's and the dealer's completed hand is limited to no more than three cards.

3. The method for playing a card game of claim 1 further comprising providing a special payout or automatic win on a player hand having a final count value of nine from three cards with each card having a point value of three or a hand comprising of three cards of the same suit with one card having a point value of two, a second card having a point value of three and a third card having a point value of four or on both types of player hand.

4. The method for playing a card game of claim 1 further comprising providing splitting an initial pair of cards having equal numerical values into separate hands and playing each hand independently.

5. The method for playing a card game of claim 4 wherein the splitting is limited to three separate hands after splitting.

6. The method for playing a card game of claim 4 wherein the splitting of court cards having the same numerical value is limited to the same court cards.

7. The method for playing a card game of claim 1 further comprising ruling a two card hand of nine winning over a three card hand of nine.

8. The method for playing a card game of claim 7 wherein a three card hand still wins over a two card hand only if the three card hand all have a score of three or if the three cards are of the same suit with one card having a point value of two, a second card having a point value of three and a third card having a point value of four.

9. The method for playing a card game of claim 7 wherein a two card hand of nine having no face card is ruled a better or a worst hand than a two card hand of nine having a face card or a ten card.

10. The method for playing a card game of claim 1 wherein the card game is a wagering card game and a bet is placed by the player on the outcome of the card game, the player being paid for winning the game, the player keeping the bet on a tie or the bet being collected by the dealer when the player loses.

11. A method for playing a card game by at least one player and a dealer with playing cards, comprising:

(a) providing at least one deck of playing cards comprising four suits totaling fifty two cards, with each suit including thirteen cards ranking from ace to ten and through court cards, jack, queen and king, the deck of cards shuffled before playing;

(b) assigning a point value to each of the playing cards, with the ace through nine of each suit counted at face value of one through nine points, and the ten through king of each suit being assigned a point value of zero by dropping the tens digit;

(c) dealing an initial player's hand of two cards to the player and an initial dealer's hand of two cards to the dealer, the point value of the initial dealer's hand not revealed by facing at least one of the two dealer's cards down;

(d) adding the point values of the initial player's hand or the player's separate hands and dropping the tens digit of the point value if any to provide a count value between zero and nine;

(e) hitting a third card by the player if desired and adding the point values of the resulting three card player's hand, dropping the tens digit of the sum of the three card player's hand to provide a count value between zero and nine;

(f) declaring an automatic loss for the player having a completed hand scoring two or less, including a score of zero;

(g) exposing the initial dealer's hand after the player has acted completely on his hand thereby revealing the point value of the initial dealer's hand;

(h) adding the point values of the initial dealer's hand and dropping the tens digit of the point value to provide a count value between zero and nine;

(i) completing the dealer's hand by hitting a third playing card when the point value of the initial dealer's hand is zero to four and standing if the point value is five to nine;

(j) adding the point value of the dealer's hand, dropping the tens digit if any, to provide a final count value between zero and nine; and, (k) comparing the final count value of the dealer's hand with the count value of the player's completed hand, a player's completed hand having a count value closer to nine and greater than the dealer's final count value resulting in a win for the player, a player keeping his/her bet when a tie is on a count value of three to nine, and a player's completed hand having a count value less than the dealer's final count value resulting in a loss for the player.

12. The method for playing a card game of claim 11 wherein the player's and the dealer's completed hand is limited to no more than three cards.

13. The method for playing a card game of claim 11 wherein the card game is a wagering card game and a bet is placed by the player on the outcome of the card game, the player being paid for winning the game, the player keeping the bet on a tie or the bet being collected by the dealer when the player loses.

14. The method for playing a card game of claim 13 further comprising providing more than one deck of card for the game, designating certain areas for placing the cards and the player's bet, designating uniform hand signals for standing or hitting another card, limiting the amount of bet and payouts, using a cut card to signal the termination of the game, discarding the first card before dealing the cards to the player and the dealer.

15. The method of claim 13 wherein a completed two card hand of nine wins over a three card hand of nine.

16. The method for playing a card game of claim 13 further comprising providing a special payout for a player having a two card hand of nine having no face card or a ten card.

17. The method for playing a card game of claim 13 further comprising providing a special payout for a player having a two card hand of nine having a face card or a ten card.

18. The method for playing a card game of claim 13 further comprising providing a special payout for a player having a two card hand of nine having no face card or a ten card and an even payout for a two card hand having a face card or a ten card.

19. A method for playing a card game having favorable odds for a dealer or a casino, comprising:

(a) providing more than one deck of playing cards comprising four suits totaling fifty two cards, with each suit including thirteen cards ranking from ace to ten and through court cards, jack, queen and king, the deck of cards shuffled before playing;

(b) assigning a point value to each of the playing cards, with the ace through nine of each suit counted at face value of one through nine points, and the ten through king of each suit being assigned a point value of zero by dropping the tens digit;

(c) dealing an initial player's hand of two cards to the player and an initial dealer's hand of two cards to the dealer, the point value of the initial dealer's hand not revealed by facing at least one of the two dealer's cards down;

(d) adding the point values of the initial player's hand or the player's separate hands and dropping the tens digit of the point value if any to provide a count value between zero and nine;

(e) hitting a third card by the player if desired and adding the point values of the resulting three card player's hand, dropping the tens digit of the sum of the three card player's hand to provide a count value between zero and nine;

(f) declaring an automatic loss for the player having a completed hand scoring two or less, including a score of zero;

(g) exposing the initial dealer's hand after the player has acted completely on his hand thereby revealing the point value of the initial dealer's hand;

(h) adding the point values of the initial dealer's hand and dropping the tens digit of the point value to provide a count value between zero and nine;

(i) completing the dealer's hand by hitting a third playing card when the point value of the initial dealer's hand is zero to four and standing if the point value is five to nine;

(j) adding the point value of the dealer's hand, dropping the tens digit if any, to provide a final count value between zero and nine;

(k) comparing the final count value of the dealer's hand with the count value of the player's completed hand, a player's completed hand having a count value closer to nine and greater than the dealer's final count value resulting in a win for the player, a player's completed hand having a count value of three to nine equal to the dealer's final count value, resulting into a tie, and a player's completed hand having a count value less than the dealer's final count value resulting in a loss for the player; and, (l) ruling a win on a completed hand of two cards scoring a nine over a three card hand scoring a nine, the two card of nine having no face cards or a card of ten given a special payout while the two card of nine having a face card or a card of ten given an even payout.

* * * * *